US012668935B2

(12) United States Patent
Ustach et al.

(10) Patent No.: US 12,668,935 B2
(45) Date of Patent: Jun. 30, 2026

(54) IMPACT ABSORBING BOLLARD

(71) Applicant: McCue Corporation, Danvers, MA (US)

(72) Inventors: Thomas Ustach, Boston, MA (US); Matthew O'Brien, Gresham, OR (US)

(73) Assignee: McCue Corporation, Danvers, MA (US)

( * ) Notice: Subject to any disclaimer, the term of this patent is extended or adjusted under 35 U.S.C. 154(b) by 719 days.

(21) Appl. No.: 18/078,127

(22) Filed: Dec. 9, 2022

(65) Prior Publication Data

US 2023/0183930 A1 Jun. 15, 2023

Related U.S. Application Data

(60) Provisional application No. 63/287,615, filed on Dec. 9, 2021.

(51) Int. Cl.
*E01F 9/627* (2016.01)

(52) U.S. Cl.
CPC ..... *E01F 9/627* (2016.02)

(58) Field of Classification Search
CPC ..... E01F 15/14
See application file for complete search history.

(56) References Cited

U.S. PATENT DOCUMENTS 5,199,814 A * 4/1993 Clark ..... E01F 9/629 116/63 P
5,597,262 A 1/1997 Beavers et al.
8,915,670 B2 * 12/2014 Ustach ..... E01F 9/629 404/9
2008/0179579 A1 * 7/2008 McGinness ..... E04H 12/2253 256/64
2010/0172692 A1 * 7/2010 McCue ..... E01F 9/627 404/6
2014/0053441 A1 * 2/2014 Arons ..... G09F 23/00 40/606.03
2014/0255648 A1 * 9/2014 Meek ..... E01F 9/681 428/137
2015/0027014 A1 * 1/2015 Smith ..... G09F 23/00 40/607.03
2017/0254033 A1 * 9/2017 Meek ..... E01F 9/627
(Continued)

FOREIGN PATENT DOCUMENTS

CA 2462739 A1 10/2005
CA 3149698 A1 * 2/2021 ..... F16F 1/371
(Continued)

OTHER PUBLICATIONS

International Search Report, PCT Application No. PCT/US2022052329, mailed Mar. 15, 2023 (3 pages).

*Primary Examiner* — Abigail A Risic
(74) *Attorney, Agent, or Firm* — Young Basile Hanlon & MacFarlane, P.C.

(57) ABSTRACT

An apparatus includes an inner core including a metal tube with a flange attached to its distal end, an elastic bumper assembly configured to enclose the distal end of the inner core therein, and a number of anchor assemblies, each anchor assembly including a washer and an anchor. Each anchor assembly extends through the bumper assembly and the flange such that a portion of the bumper assembly is held captive between the washer of the anchor assembly and the flange.

17 Claims, 3 Drawing Sheets

(56) References Cited

U.S. PATENT DOCUMENTS

| | | | | |
|---|---|---|---|---|
| 2020/0270830 | A1* | 8/2020 | Parrott | E01F 9/629 |
| 2024/0060254 | A1* | 2/2024 | Ustach | E01F 15/14 |
| 2024/0401289 | A1* | 12/2024 | Dondlinger | B65G 69/287 |

FOREIGN PATENT DOCUMENTS

| | | | | |
|---|---|---|---|---|
| EP | 0641889 | A1 | | 3/1995 |
| FR | 2709501 | B1 | * | 11/1995 |
| KR | 200438760 | Y1 | | 3/2008 |
| KR | 102168269 | B1 | | 10/2020 |
| RU | 206078 | U1 | | 8/2021 |

* cited by examiner

IMPACT ABSORBING BOLLARD

CROSS-REFERENCES TO RELATED APPLICATIONS

This application claims the benefit of U.S. Provisional Application No. 63/287,615 filed on Dec. 9, 2021. The entire contents of U.S. Provisional Application No. 63/287,615 are incorporated herein by reference.

BACKGROUND OF THE INVENTION

This invention relates to an impact absorbing bollard.

The last leg of a journey, where people and/or goods are moved from a transportation hub to a final destination is often referred to as the "last mile." For the last mile transportation of goods (e.g., consumer goods), a delivery vehicle drives into a loading area of a warehouse and workers load the delivery vehicle with goods for delivery by the vehicle.

As delivery vehicles and workers interact at a warehouse, there is a potential for accidental contact between the vehicles, the workers, and the structure of the warehouse. Such accidents can cause property damage or even serious injury to workers.

SUMMARY OF THE INVENTION

Aspects described herein relate to a bollard that can be installed in a warehouse to protect warehouse workers, delivery vehicles, and structural elements of a warehouse as delivery vehicles are loaded with goods for last mile delivery.

In a general aspect of the invention, an impact absorbing bollard apparatus includes an inner core including a metal tube with a flange attached to its distal end, an elastic bumper assembly configured to enclose the distal end of the inner core therein, and a number of anchor assemblies, each anchor assembly including a washer and an anchor. Each anchor assembly extends through the bumper assembly and the flange such that a portion of the bumper assembly is held captive between the washer of the anchor assembly and the flange.

Embodiments may include one or more of the following features.

The elastic bumper assembly of the apparatus may include two halves. Each half of the elastic bumper assembly may be configured to accommodate a part of the flange and one or more anchor assembly of the anchor assemblies.

The anchor assemblies of the apparatus may attach the apparatus to a surface and the flange may be spaced apart from the surface by a part of the elastic bumper assembly.

The apparatus may further include a plastic cover disposed on the inner core. An outer diameter of the plastic cover may be less than an outer diameter of the elastic bumper assembly. The plastic cover may extend along a length of the inner core. Alternatively, the plastic cover may rest on a top end of the bumper assembly. In one example, a distal end of the plastic cover may include reflective rings to increase visibility. In another example, a foam tape may be attached to the inner core to separate the plastic cover away from the inner core to prevent the inner core and the plastic cover from rattling against each other.

The bumper assembly may be made of an elastomeric material. In one example, the walls of the bumper assembly are approximately ¾ inches thick. The bumper assembly may further include a number of anchor receptacles and the apparatus may be attached to the surface by inserting the anchor assemblies into the anchor receptacles. The washers rest at the bottom of the anchor receptacles and prevent the anchor assemblies from passing entirely through the bottom of the anchor receptacles.

The apparatus may further include a number of gussets welded to the metal tube and the flange to provide reinforcement to the inner core under an impact.

Other features and advantages of the invention are apparent from the following description, and from the claims.

DETAILED DESCRIPTION

Figure 1:
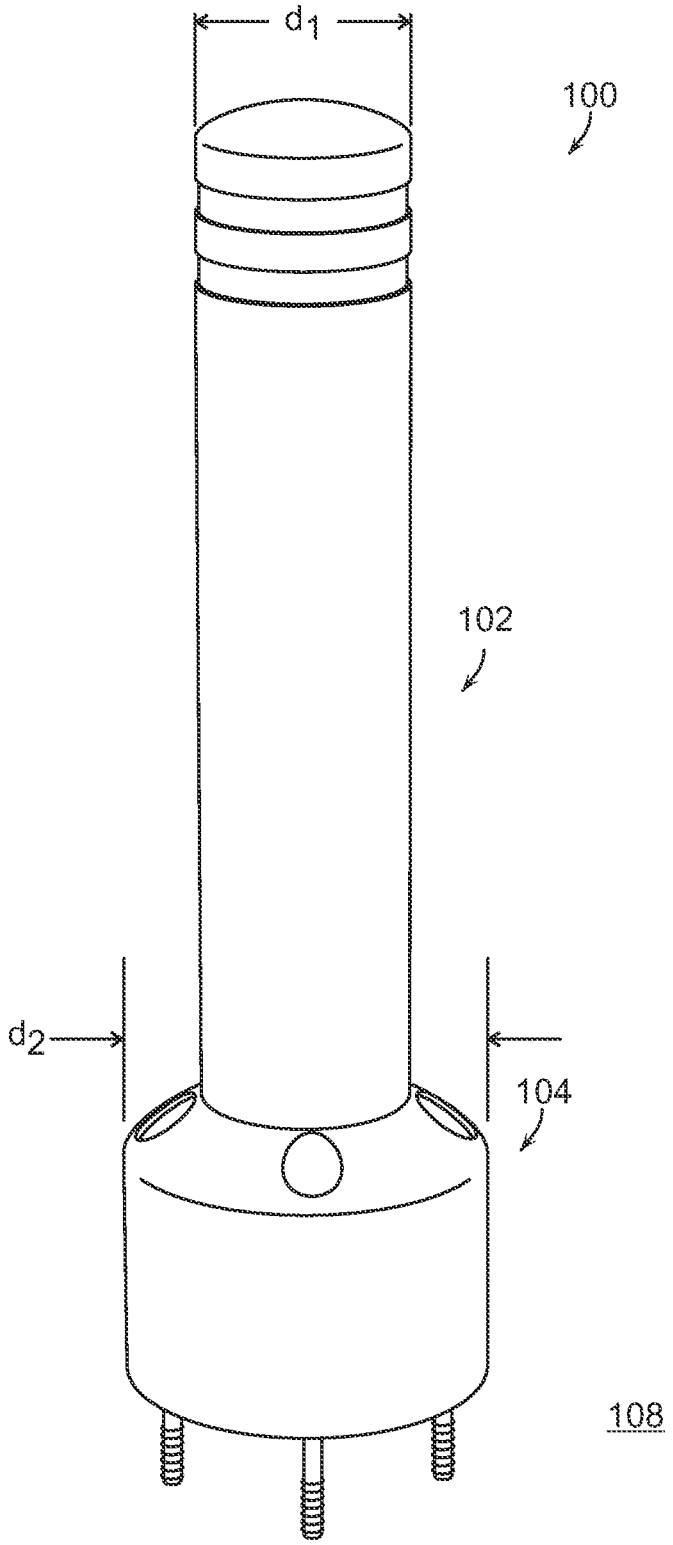
FIG. 1 is an impact absorbing bollard.

Referring to FIG. 1, an impact absorbing bollard 100 is configured for installation in a ground-surface 108 in a warehouse facility to protect warehouse workers, delivery vehicles, and structural elements of the warehouse facility as delivery vehicles are loaded with goods for last mile delivery.

The bollard 100 includes an upper portion 102 and a lower portion 104. The upper portion 102 is configured to safely receive and absorb impacts from delivery vehicles as they move in and about the warehouse facility. The lower portion 104 is configured to receive impacts from trolleys or carts (not shown) that workers in the warehouse use to transport goods for loading onto the delivery vehicles. A diameter, $d_1$ of the upper portion 102 is less than a diameter, $d_2$ of the lower portion 104 to ensure that parts of a worker's body are not pinched between a trolley or cart and the upper portion 102 when the trolley or cart impacts the lower portion 104.

Figure 2:
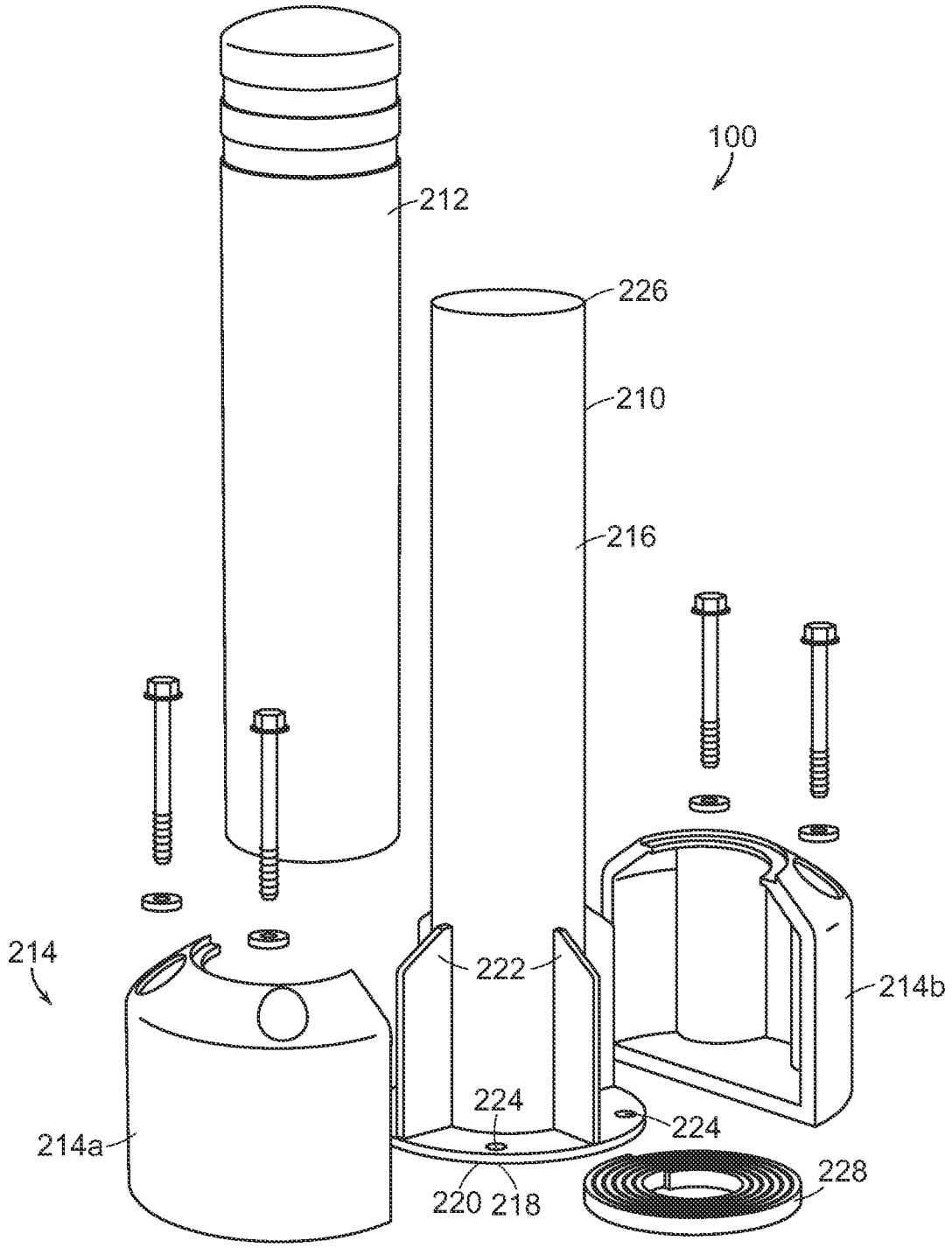
FIG. 2 is an exploded view of the impact absorbing bollard of FIG. 1.

Referring to FIG. 2, the bollard 100 includes an inner core 210, a plastic cover 212 and a two-piece impact absorbing bumper assembly 214. The inner core 210 includes a hollow metal tube 216 with a flange 218 welded to its distal end 220. The flange 218 includes a number of through-holes 224 that accommodate anchors when the bollard 100 is attached to the ground (as is described in greater detail below). Reinforcing gussets 222 are welded to the hollow metal tube 210 and the flange 218 to provide additional strength when the bollard 100 is struck.

The plastic cover 212 is sized and shaped to slide onto and over the inner core 210 from its distal end 226. In some examples, a foam tape 228 is attached to the inner core 210 prior to placing the plastic cover 212 thereon. The foam tape 228 holds the plastic cover 212 away from the inner core 210 to prevent the two members from rattling against each other.

Figure 3:
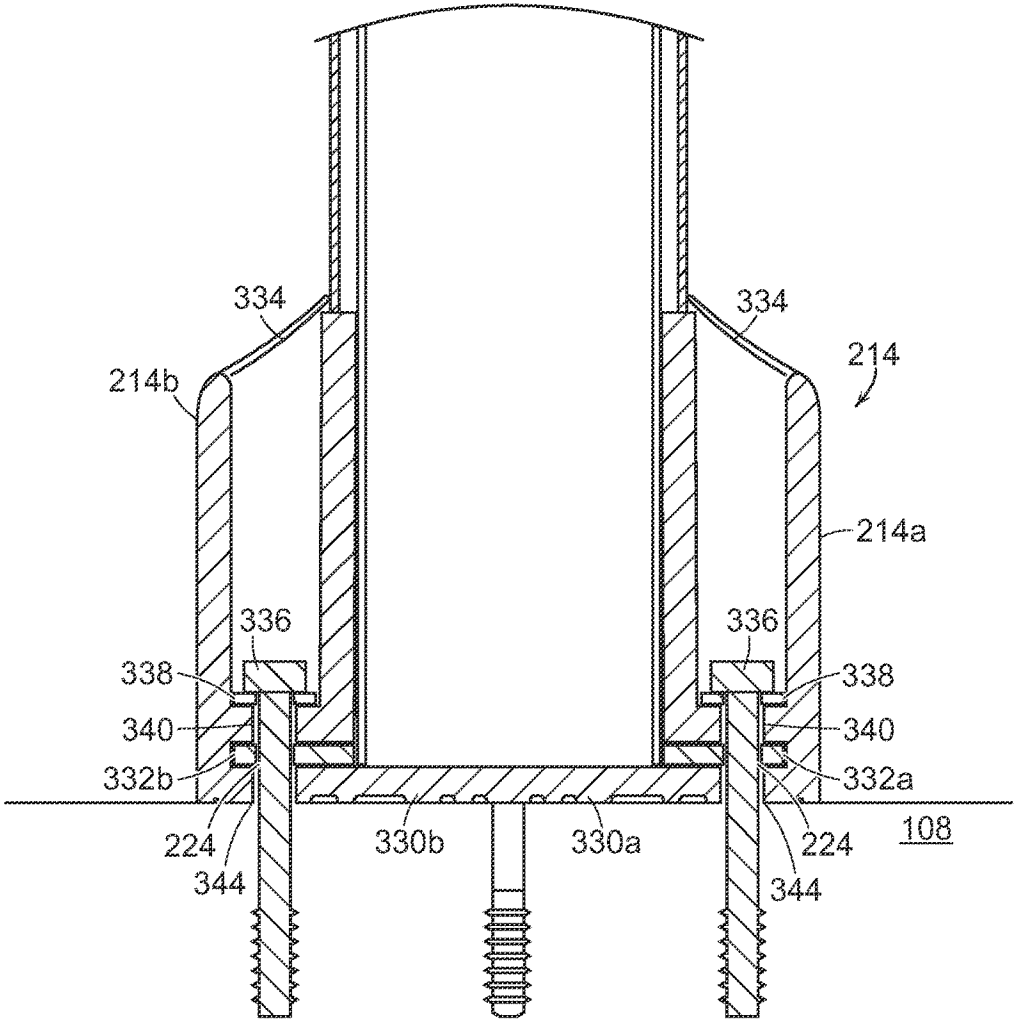
FIG. 3 is a cross-sectional view of a lower portion of the impact absorbing bollard of FIG. 1.

Referring to FIGS. 2-3, the bumper assembly 214 is made of an elastomeric material (e.g., ethylene propylene diene monomer (EPDM) rubber) and includes a first half 214*a* and a second half 214*b*. Each of the halves includes a corresponding bottom wall 330*a*, 330*b* and a corresponding flange-receiving slot 332*a*, 332*b*. When the two halves 214*a*, 214*b* of the bumper assembly 214 are installed on the distal end 220 of the inner core 210 (like closing a clamshell), the flange 218 of the inner core 210 rests on the bottom walls 330*a*, 330*b* of the two halves 214*a*, 214*b* and extends into the flange-receiving slots 332*a*, 332*b*. The flange 218 is therefore separated from the surface 108 by the bottom walls 330*a*, 330*b*, and has its motion restricted by virtue of the flange 218 being in the flange-receiving slots 332*a*, 332*b*.

Figure 4:
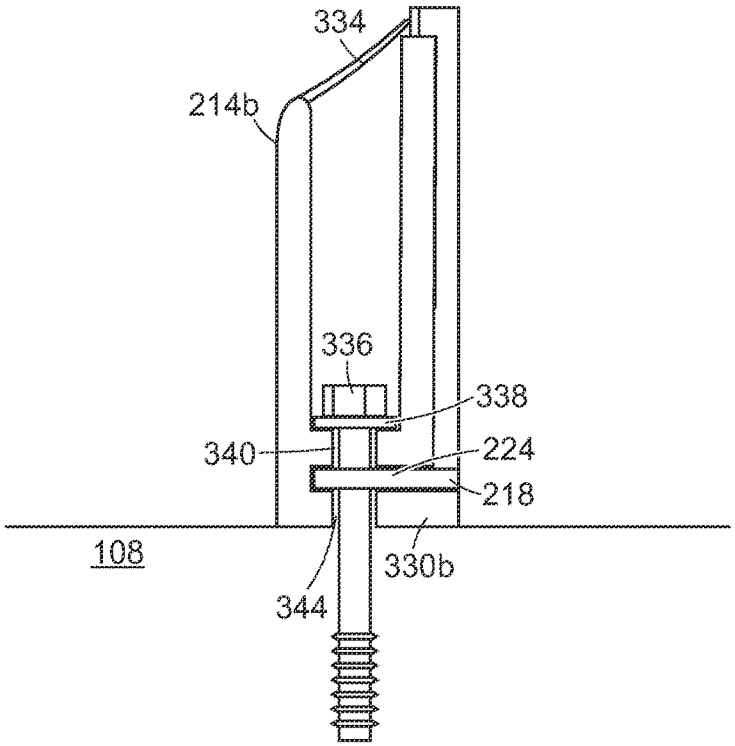
FIG. 4 is a cut-away view of an impact absorbing section of the impact absorbing bollard of FIG. 1.

Referring to FIGS. 3-4, the first half 214*a* and the second half 214*b* of the bumper assembly 214 also include anchor receptacles 334. The bollard 100 is attached to the surface 108 by inserting anchors 336 including washers 338 into the anchor receptacles 334, through through-holes 340 at a bottom of the anchor receptacles 334, through the through-holes 224 in the flange 218, through through-holes 344 in the bottom walls 330*a*, 330*b*, and finally into the surface 108. The washers 338 rest at the bottom of the anchor receptacles 334 and prevent the anchors 336 from passing entirely through the through-holes 340 at the bottom of the anchor receptacles 334.

In operation, when the bollard 100 is struck by a vehicle, the inner core 210 is caused to deflect away from the impact. As the inner core 210 deflects, portions of the bumper assembly 214 that reside between the washers 338 and the flange 218 are compressed between the washers 338 and the flange 218, thereby absorbing the force of the impact. When the impact subsides, those portions of the bumper assembly 214 decompress and return the bollard 100 to its original, undeflected position.

1 ALTERNATIVES

In some examples, walls of the bumper assembly are approximately ¾ inches thick.

In some examples, the gussets of the inner core provide structural stability, including strengthening the attachment of the flange to the hollow metal tube and reinforcing the distal end of the inner core against bending when the bollard is struck.

In some examples, the plastic cover extends along a length of the inner core. In other examples, the plastic cover rests (e.g., in a notch) on a top end of the bumper assembly. In some examples, a distal end of the plastic cover includes reflective rings to increase visibility.

In some examples, an impact absorbing bollard apparatus includes an inner core including a metal tube with a flange attached to its distal end, an elastic bumper assembly configured to enclose the distal end of the inner core therein, and a number of anchor assemblies, each anchor assembly including a washer and an anchor. Each anchor assembly (including a fastener and a washer) extends through openings or receptacles the bumper assembly and the flange such that a portion of the bumper assembly is held captive between the washer of the anchor assembly and the flange.

The elastic bumper assembly of the apparatus may include two halves. Each half of the elastic bumper assembly may be configured to accommodate a part of the flange and one or more anchor assembly of the anchor assemblies. The anchor assemblies of the apparatus may attach the apparatus to a surface and the flange may be spaced apart from the surface by a part of the elastic bumper assembly. The apparatus may further include a plastic cover disposed on the inner core. An outer diameter of the plastic cover may be less than an outer diameter of the elastic bumper assembly. The plastic cover may extend along a length of the inner core. Alternatively, the plastic cover may rest on a top end of the bumper assembly. In one example, a distal end of the plastic cover may include reflective rings to increase visibility. In another example, a foam tape may be attached to the inner core to separate the plastic cover away from the inner core to prevent the inner core and the plastic cover from rattling against each other.

The bumper assembly may be made of an elastomeric material. In one example, the walls of the bumper assembly are approximately ¾ inches thick. The bumper assembly may further include a number of anchor receptacles and the apparatus may be attached to the surface by inserting the anchor assemblies into the anchor receptacles. The washers rest at the bottom of the anchor receptacles and prevent the anchor assemblies from passing entirely through the bottom of the anchor receptacles. The apparatus may further include a number of gussets welded to the metal tube and the flange to provide reinforcement to the inner core under an impact. Each opening may extend from a bottom of the respective receptacle to the surface. The inner core may be rigid and extend through a height of the apparatus. Upon impact to the apparatus, the inner core may be configured to pivot around an edge of the flange. The elastic bumper assembly may be configured to absorb impact forces and prevent direct contact between the flange and the surface during pivoting.

A number of embodiments of the invention have been described. Nevertheless, it is to be understood that the foregoing description is intended to illustrate and not to limit the scope of the invention, which is defined by the scope of the following claims. Accordingly, other embodiments are also within the scope of the following claims. For example, various modifications may be made without departing from the scope of the invention. Additionally, some of the steps described above may be order independent, and thus can be performed in an order different from that described.

What is claimed is:

1. An apparatus comprising:

an inner core including a metal tube with a flange attached to its distal end;

an elastic bumper assembly configured to enclose the distal end of the inner core therein; and a plurality of anchor assemblies, each anchor assembly including a washer, wherein each anchor assembly of the plurality of anchor assemblies extends through the bumper assembly and the flange such that a portion of the bumper assembly is held captive between the washer of the anchor assembly and the flange.

2. The apparatus of claim 1, wherein the elastic bumper assembly includes two halves.

3. The apparatus of claim 2 wherein each half of the elastic bumper assembly is configured to accommodate a part of the flange and one or more anchor assemblies of the plurality of anchor assemblies.

4. The apparatus of claim 1 wherein the plurality of anchor assemblies attaches the apparatus to a surface and the flange is spaced apart from the surface by a part of the elastic bumper assembly.

5. The apparatus of claim 1 further comprising a plastic cover disposed on the inner core.

6. The apparatus of claim 5 wherein an outer diameter of the plastic cover is less than an outer diameter of the elastic bumper assembly.

7. The apparatus of claim 1 wherein the bumper assembly is made of an elastomeric material.

8. The apparatus of claim 1, further comprising a plurality of gussets attached to the metal tube and the flange and configured to reinforce the inner core under an impact.

9. The apparatus of claim 5, wherein the plastic cover extends along a length of the inner core.

10. The apparatus of claim 5, wherein a distal end of the plastic cover includes reflective rings to increase visibility.

11. The apparatus of claim 5, wherein a foam tape is attached to the inner core to separate the plastic cover from the inner core.

12. The apparatus of claim 4, wherein the bumper assembly further comprises a plurality of anchor receptacles and the apparatus is attached to the surface by inserting the plurality of anchor assemblies through openings in the plurality of anchor receptacles and into the surface.

13. The apparatus of claim 12, wherein the washers of the plurality of anchor assemblies prevent respective distal ends of the plurality of anchor assemblies from passing through the openings in the plurality of anchor receptacles.

14. The apparatus of claim 13, wherein each anchor assembly of the plurality of anchor assemblies includes a fastener and the washers of the plurality of anchor assemblies prevent respective distal ends of the fasteners of the plurality of anchor assemblies from passing through the openings in the plurality of anchor receptacles.

15. The apparatus of claim 12, wherein each opening extends from a bottom of the respective receptacle to the surface.

16. The apparatus of claim 4, wherein the inner core is rigid and extends through a height of the apparatus, and wherein upon impact to the apparatus, the inner core is configured to pivot around an edge of the flange.

17. The apparatus of claim 16 where the elastic bumper assembly configured to absorb impact forces and prevent direct contact between the flange and the surface during pivoting.

* * * * *